United States Patent [19]

Lenzini et al.

[11] 4,418,976

[45] Dec. 6, 1983

[54] RETAINING CLIP FOR AN ELECTRICAL CONNECTOR

[75] Inventors: Albert A. Lenzini, Mundelein; Robert C. Swanson; James T. Roberts, both of Chicago; John A. Pruski, Schiller Park, all of Ill.

[73] Assignee: Teletype Corporation, Skokie, Ill.

[21] Appl. No.: 311,851

[22] Filed: Oct. 16, 1981

[51] Int. Cl.[3] ..... H01R 13/627

[52] U.S. Cl. ..... 339/91 R; 339/17 LC; 339/75 P

[58] Field of Search ..... 339/17 LC, 91 R, 75 P

[56] References Cited

U.S. PATENT DOCUMENTS

| | | | |
|---|---|---|---|
| 1,835,251 | 12/1931 | Wetstein | 339/91 R |
| 2,434,521 | 1/1948 | Savage | 339/75 P |
| 2,753,536 | 7/1956 | Tjader | 339/75 P |
| 3,005,176 | 10/1961 | Berg | 339/75 P |
| 3,573,706 | 4/1971 | Haberlen | 339/91 R |

FOREIGN PATENT DOCUMENTS

| | | | |
|---|---|---|---|
| 7705393 | 11/1977 | Netherlands | 339/91 R |

OTHER PUBLICATIONS

IBM Technical Disclosure Bulletin, vol. 22, No. 3, 8/79, "Cable Paddle Card Restraint", J. J. Best.

IBM Technical Disclosure Bulletin, vol. 21, No. 6, 10/78, "Connector Retainer", M. L. Cahill.

*Primary Examiner*—John McQuade

*Attorney, Agent, or Firm*—W. K. Serp; J. C. Albrecht

[57] ABSTRACT

A connector clip 12 is shown having a "U" shaped body member 30 including a base 34 and two parallel, extending legs 32. The ends of each of the legs 32 define camming surfaces 42 and a socket retaining notch 44. The clip includes a pair of first spacing feet 47 positioned medially upon each leg 32 and a pair of second spacing feet 36 located at the ends of a base member 34. The feet 36, 47 serve to limit relative movement between the clip 12 and a plug 14 which holds the clip 12 to a circuit board 22. A pair of spaced fingers 48 together with the circuit board 22 and the facing surfaces of the legs 32 define an access opening which serves to align the socket 24 with a plug 14. The second embodiment of FIGS. 5 and 6 includes a pair of arms 50 which engage the circuit board 22 surface opposite the surface upon which the plug 14 is mounted. The arms 50 prevent relative movement between the clip 12 and the circuit board 22.

6 Claims, 6 Drawing Figures

FIG. 5
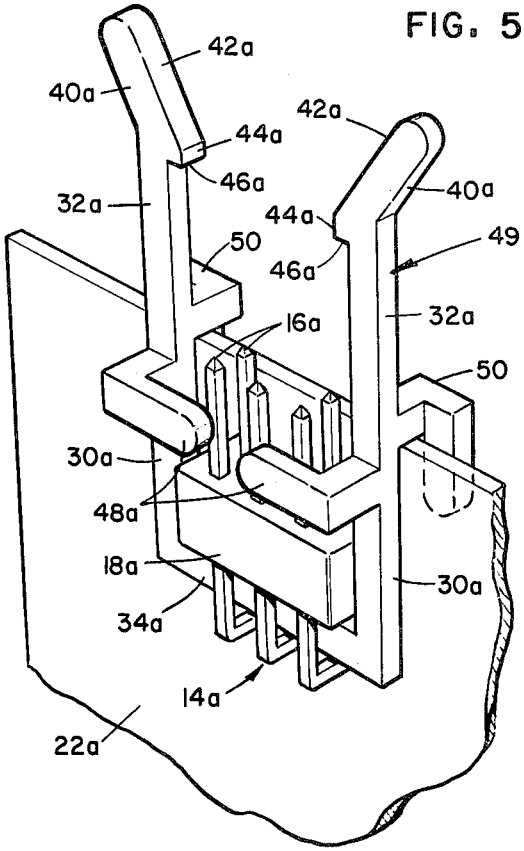
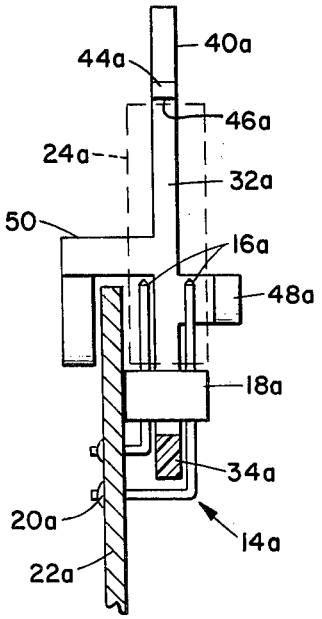
FIG. 6

RETAINING CLIP FOR AN ELECTRICAL CONNECTOR

DESCRIPTION

1. Technical Field

This invention relates to an electrical connector retaining clip for securely holding a socket and mating plug in physical engagement.

2. Background Art

Frequently, several printed circuit boards are connected by socket terminated cables. The socket mates with a plug soldered on the circuit board. Such circuit boards are subject to occasional vibration and other undesired movement which may cause the connectors to loosen and ultimately become disconnected. An additional problem encountered with such connectors is that the plug and socket forming the connection will not be in the desired alignment when mated thus resulting in malfunction or damage to the circuitry mounted on the circuit board.

DISCLOSURE OF THE INVENTION

This invention relates to an apparatus for releasably maintaining a socket in engagement with a plug securely soldered to a printed circuit board. The plug includes at least two spaced pins maintained in relative position by a molded strip. The pins are bent and soldered to the circuit board so that the free ends of the pins extend along a plane parallel to the circuit board. The clip is "U" shaped and includes a pair of extending legs and a base. The base is sized to fit between the spaced pins of the plug, and the legs of the clip define means for grasping the socket thus securely retaining the socket within the legs of the "U" shaped clip. A pair of fingers are secured to and extend from the legs toward each other and prevent misalignment between the plug and the socket. Thus, the facing surfaces of the fingers, the legs and the circuit board serve to direct the socket and plug into accurate mating engagement.

THE DRAWINGS

FIG. 5 is a perspective view of an alternate embodiment of a clip in combination with a connector plug mounted to a circuit board; and FIG. 6 is a side view of the apparatus of FIG. 5 with a connector socket shown in phantom to more clearly illustrate certain features of this invention.

DETAILED DESCRIPTION

Figure 3:
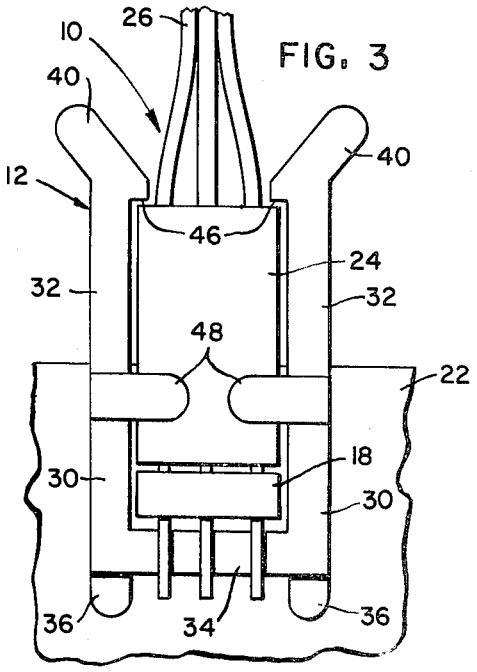
FIG. 3 is a front plan view similar to FIG. 2 with the connector socket and plug in engagement.
Figure 4:
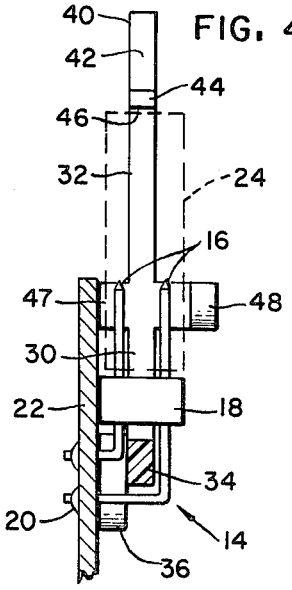
FIG. 4 is a side view of the clip of FIG. 3 with the connector socket shown in phantom to more clearly illustrate certain features of this invention.

As illustrated, the connector 10 with which the clip 12 is designed to cooperate includes a male plug 14 having two parallel rows of pins 16. The pins 16 are maintained in spaced orientation by a molded plastic insulating strip 18. The pins 16 of the plug 14 are bent over at a right angle and a first end of each pin is soldered to foil pads 20 on a printed circuit board 22. The second terminal ends of the pins 16 are parallel to the circuit board 22 and spaced therefrom. The plug 14 is adapted to mate with a socket 24 to which a cable 26 is connected as shown in FIG. 3. The connector 10 is similar to that manufactured and sold by the Berg Electronics a Division of DuPont Corporation under the trademark "BergStik" headers and is described in their brochure, "Panel Products 500 Bulletin".

Figure 1:
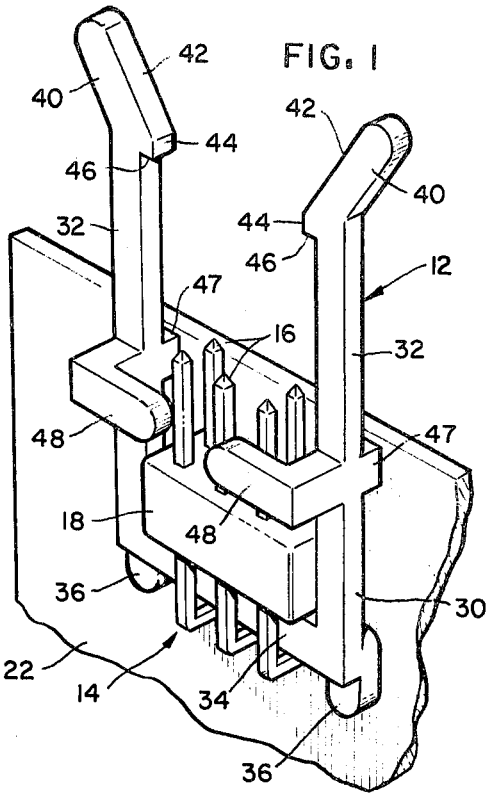
FIG. 1 is a perspective view of a clip in combination with a connector plug mounted to a circuit board.

The clip 12 includes a "U" shaped body 30 having a pair of substantially parallel elongated resilient legs 32 and a base member 34 connecting the legs 32 at the ends thereof. The body 30 is preferably fabricated by molding nylon or other similar resilient insulating material. The base 34, as shown in FIG. 1, passes between the two rows of plug pins 16 before the plug 14 is soldered to the circuit board 22 and the clip 12 is thus captively held in place by the circuit board 22, the pins 16 and the plastic insulating strip 18. Molded to the ends of the base 34 on the surface thereof adjacent the circuit board 22 are a pair of feet 36 which space the base 34 from the circuit board 22. The feet 36 project beyond the legs 32 and serve to prevent rotational movement of the clip 12 with respect to the pins 16. As illustrated, the legs 32 of the U-shaped body member 30 exteend along the line of the pins 16 and, at their terminal ends are flared as at 40 defining camming surfaces 42. As will be subsequently more fully appreciated, the flared ends of the legs 32 facilitate movement of the legs 32 outwardly, thus increasing the distance between the legs 32 allowing entry and removal of the connector socket 24. Serving to prevent accidental removal of the socket 24 when engaged with the plug pins 16, the inwardly disposed surfaces of the legs 32 define opposing locking tabs 44 having a flattened surface 46 disposed toward the base 34 of the "U" shaped body 30 of the clip 12.

Additionally, the legs 32 are spaced from the circuit board 22 by a pair of short spacers 47 which project from the surface of each of the legs 32 and are disposed toward the circuit board 22. The spacers 47 and the feet 36 locate the plane of the clip 12 generally parallel to the circuit board 22 and parallel to the second terminal end of the plug pins 16. Serving to facilitate orientation of the plug 14 and the socket 24 are a pair of opposing fingers 48 which extend and project inwardly from the legs 32. The space defined by the surface of the circuit board 22, the opposite surfaces of the legs 32 and the fingers 48 is approximately the size and shape of a cross-section of the socket 24. Thus, during connection, alignment between the socket 24 and the plug pins 16 is assured.

Figure 2:
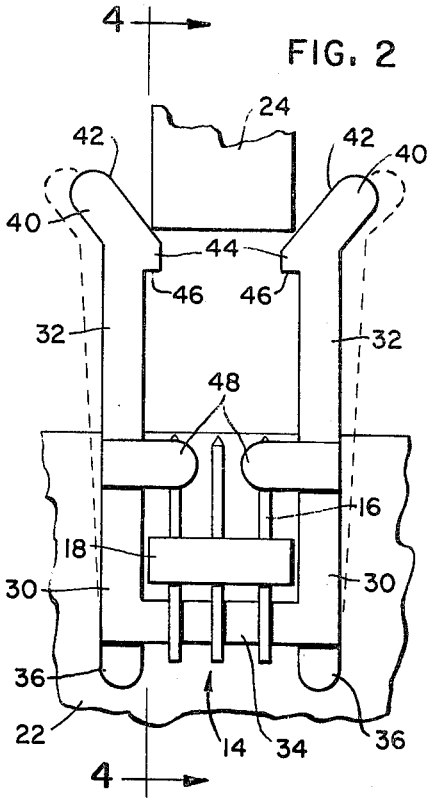
FIG. 2 is a front plan view of the clip of FIG. 1 and a connector socket prior to engagement with the plug.

In use, the clip 12 is positioned within the pins 16 and the pins 16 are soldered to the circuit board 22 thus holding the clip 12 securely in place. It should be appreciated that no portion of the clip 12 extends below the lower surface of the circuit board 22, and thus circuit components may be flow soldered to the circuit board 22 without damage to the clip 12. The socket 24, with the cable 26 attached, is roughly aligned with the pins 16 and advanced toward the pins 16. As the socket 24 engages the clip 12, the body of the socket 24 strikes the camming surfaces 42 of the flared ends 40 of the legs 32. The legs 32 are forced apart, as shown in phantom in FIG. 2, thus allowing engagement of the socket 24 with the plug pins 16 mounted upon the circuit board 22. In the event the socket 24 is misaligned with respect to the plug pins 16, advance of the socket 24 will be obstructed by either the circuit board 22 or the alignment fingers 48 thus preventing engagement of the plug 14 and socket 24. Once alignment has been obtained, the connection is completed by forcing the socket 24 against the plug 14 and the locking tabs 44 will pass over the end of the socket 24 thus preventing accidental removal of the socket. Due to the resiliency of the structural material of the legs 32, the legs will move together and the locking surfaces 46 will pass over the end of the socket 24 as shown in FIG. 3. To remove the socket 24, the flared ends 40 of the legs 32 are manually forced apart to release the locking tabs 44 and the socket 24 is freely withdrawn from the pins 16.

A second embodiment of a clip 49 is illustrated in FIG. 5 wherein those components of the second embodiment which correspond to the first embodiment are designated by the same reference number with the subscript "a". Extending from and medially positioned on the surface of each leg 32*a*, adjacent the circuit board 22*a*, are locking arms 50 which are offset and bent to extend along the axis of the legs 32*a* toward the base 34*a* along the solder side of the circuit board 22*a*. The arms 50 serve to limit movement of the clip 49 relative to the circuit board 22*a*. The clip 49, in the embodiment of FIGS. 5 and 6, is mounted by positioning the clip 12*a* on the circuit board 22*a* in the desired location and thereafter soldering the pins 16*a* thus holding the clip 49 captive to the circuit board 22*a*. The operation of the clip 49 of the second embodiment is similar to the operation of the clip 12 of the first embodiment and the readers attention is directed to the preceding discussion.

Although the invention has been particularly shown and described with reference to two embodiments, it will be understood that various changes in form and detail may be made without departing from the scope and spirit of the invention as defined by the following claims.

What is claimed is:

1. A retaining clip (12) for releasably maintaining a socket (24) in engagement with a plug (14) securely soldered to a circuit board (22), the plug (14) comprises at least two spaced pins (16) maintained in relative position by a molded strip (18), the pins (16) are bent and soldered to the circuit board (22) so that the free ends thereof extend along a plane generally parallel to the circuit board (22), said retaining clip (12) comprising:

a generally "U" shaped body member (30) formed of resilient insulating material and including a pair of extending legs (32) and a base (34), the base (34) of said body member (30) being sized to fit between the spaced pins (16) of the plug (14) prior to connection of the plug (14) to the circuit board (22), the legs (32) of the body member (30) define means (44) thereon for grasping the socket (24) thus securely retaining the socket (24) within the legs (32) of said "U" shaped member (30), and alignment means (48) secured to and extending from said legs (32) toward each other for preventing misalignment between the plug (14) and the socket (24), said alignment means (48), said legs (32) and the circuit board (22) defining an access opening for accurately directing the socket (24) and plug (14) into engagement.

2. The clip of claim 1 wherein the free ends of each of said legs (32) are flared (40) outwardly to define camming surfaces, each camming surface lying in a plane (42) with the planes of the camming surfaces intersecting at an acute angle between said legs (32), said flared ends (40) serving to facilitate movement of the legs upon contact with the socket to allow engagement of the socket (24) and the plug (14).

3. The clip of claim 2 wherein said socket grasping means (44) comprises a notch formed on the facing surface of each of the legs and serving to securely engage and prevent accidental removal of the socket (24).

4. The clip of claim 3 wherein said alignment means comprises a pair of opposing fingers (48) secured to and extending generally medially from said legs (32).

5. The clip of claim 3 or 4 which further includes a pair of locking arms (50) each secured to one leg of said "U" shaped member (30*a*), said arms (50) being spaced from and extending substantially along the longitudinal axis of said legs (32*a*) and projecting toward the base (34*a*) of the "U" shaped member (30*a*) so as to engage the surface of the circuit board (22*a*) opposite the surface upon which the plug (14*a*) is mounted thus limiting relative movement between the circuit board (22*a*) and the "U" shaped member (30*a*).

6. The clip of claim 3 or 4 which further includes a pair of first spacing feet (36) extending from a first surface of each of said legs (32) toward the printed circuit board (22) and serving to space the "U" shaped member (30) away from the circuit board (22) and a pair of second spacing feet (36) extending from said first surface of said "U" shaped member (30) adjacent the ends of said base (34) and serving to space said "U" shaped member (30) from the circuit board (22), said first and second spacing feet (36, 46) serving to limit relative movement between said "U" shaped member (30) and the circuit board (22).

* * * * *